US008869400B2

(12) United States Patent
Uekita

(10) Patent No.: US 8,869,400 B2
(45) Date of Patent: Oct. 28, 2014

(54) METHOD FOR MANUFACTURING A NOZZLE PLATE AND A DROPLET DISPENSING HEAD

(75) Inventor: Masahiro Uekita, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1528 days.

(21) Appl. No.: 11/859,109

(22) Filed: Sep. 21, 2007

(65) Prior Publication Data

US 2008/0100667 A1 May 1, 2008

(30) Foreign Application Priority Data

Oct. 25, 2006 (JP) ..... 2006-289802

(51) Int. Cl.
*B41J 2/16* (2006.01)
*B41J 2/145* (2006.01)
*B41J 2/14* (2006.01)

(52) U.S. Cl.
CPC ..... *B41J 2/1433* (2013.01); *B41J 2/1632* (2013.01); *B41J 2/164* (2013.01); *B41J 2/162* (2013.01); *B41J 2/1625* (2013.01)
USPC ..... 29/890.1; 29/25.35; 29/611; 29/830; 347/47

(58) Field of Classification Search
USPC ..... 29/890.1, 25.35, 611, 830, 852; 347/20, 347/44–47
See application file for complete search history.

(56) References Cited

U.S. PATENT DOCUMENTS 3,921,916 A * 11/1975 Bassous ..... 347/47
5,802,686 A * 9/1998 Shimada et al. ..... 29/25.35
6,345,424 B1 * 2/2002 Hasegawa et al. ..... 29/25.35
6,594,898 B1 * 7/2003 Yun ..... 29/890.1
6,978,543 B2 * 12/2005 Sakamoto et al. ..... 29/890.1
7,040,016 B2 * 5/2006 Bergstrom et al. ..... 29/890.1
2003/0179259 A1 * 9/2003 Tomita et al. ..... 347/20
2006/0028508 A1 * 2/2006 Chen et al. ..... 347/47

FOREIGN PATENT DOCUMENTS

JP 4-358841 12/1992
JP 06320497 A * 11/1994
JP 9-52358 2/1997
JP 2002-113875 4/2002
JP 2003-182072 7/2003
JP 2005-96188 4/2005
JP 2005-125143 5/2005
JP 2005-199430 7/2005

OTHER PUBLICATIONS

Japanese Office Action issued Aug. 19, 2011, in Patent Application No. 2006-289802 (with English-language translation).

* cited by examiner

*Primary Examiner* — A. Dexter Tugbang
(74) *Attorney, Agent, or Firm* — Oblon, Spivak, McClelland, Maier & Neustadt, L.L.P.

(57) ABSTRACT

A nozzle plate includes: a flow channel opening in a first surface of the nozzle plate; a liquid chamber communicating with the flow channel; and a nozzle hole communicating with the liquid chamber and opening in a second surface of the nozzle plate. The liquid chamber has a flat portion which is substantially parallel to the second surface. The nozzle hole communicates with the liquid chamber in the flat portion. A method for producing a nozzle plate includes: forming a liquid chamber which opens in a first surface of a plate-like body; forming a flat portion in a bottom of the liquid chamber; and forming a nozzle hole which communicates with the flat portion and opens in a second surface of the plate-like body.

13 Claims, 11 Drawing Sheets

METHOD FOR MANUFACTURING A NOZZLE PLATE AND A DROPLET DISPENSING HEAD

CROSS-REFERENCE TO RELATED APPLICATIONS

This application is based upon and claims the benefit of priority from the prior Japanese Patent Application No. 2006-289802, filed on Oct. 25, 2006; the entire contents of which are incorporated herein by reference.

BACKGROUND OF THE INVENTION

1. Field of the Invention

This invention relates to a nozzle plate, a method for producing a nozzle plate, a droplet dispensing head, a method for producing a droplet dispensing head, and a droplet dispensing device.

2. Background Art

In a recording device such as a consumer printer or in a film-forming equipment used for production of a liquid crystal display device or a semiconductor device or the like, there has been known a technique by which coloration or formation of a film is performed by dispensing and flying a ink or a film material to an object by an inkjet method.

A droplet dispensing head used in the inkjet method is also generally called as "inkjet head", and composed of precision components produced by taking advantage of sophisticated techniques. In particular, a nozzle hole portion from which an ink or a film material is dispensed exerts a great influence on fundamental operation characteristics such as a registration characteristic and a flight characteristic, and therefore, requires extremely high processing precision.

The processing of the nozzle hole portion requiring sophisticated and high processing precision is extremely difficult, and the productivity thereof is extremely low.

Therefore, for making it easy to process the nozzle hole portion to improve the productivity, there has been proposed a technique that the nozzle hole portion is composed independently from a nozzle main body of the droplet dispensing head, and each of them is individually processed and then they are integrated with an adhesive and such (see, for example, Japanese Patent Application JP-A 04-358841(Kokai)).

However, in such a technique as bonding, control of adhesion condition and the adhesive surface are difficult and stability in the production process is lacking, and the troubles such as a misalignment of the nozzle hole position or a protrusion of the adhesive cannot be completely prevented.

Therefore, there has been a technique that a nozzle hole and an ink flow channel for supplying an ink to the nozzle hole are provided in one nozzle plate (see, for example, Japanese Patent Application JP-A 2005-96188(Kokai) and JP-A 2005-199430(Kokai)).

However, in such a technique, there has been caused a new problem that such a technique exerts an bad influence on a fundamental operation characteristic such as a registration characteristic or a flight characteristic.

SUMMARY OF THE INVENTION

According to an aspect of the invention, there is provided a nozzle plate including: a flow channel opening in a first surface of the nozzle plate; a liquid chamber communicating with the flow channel; and a nozzle hole communicating with the liquid chamber and opening in a second surface of the nozzle plate, the liquid chamber having a flat portion, the flat portion being substantially parallel to the second surface, and the nozzle hole communicating with the liquid chamber in the flat portion.

According to another aspect of the invention, there is provided a method for producing a nozzle plate, including: forming a liquid chamber, the liquid chamber opening in a first surface of a plate-like body; forming a flat portion in a bottom of the liquid chamber; and forming a nozzle hole, the nozzle hole communicating with the flat portion and opens in a second surface of the plate-like body.

According to another aspect of the invention, there is provided a droplet dispensing head including: a nozzle plate; and a pressurizing device configured to apply a pressure to a liquid in a liquid chamber, the nozzle plate having: a flow channel opening in a first surface of the nozzle plate; a liquid chamber communicating with the flow channel; and a nozzle hole communicating with the liquid chamber and opening in a second surface of the nozzle plate, the liquid chamber having a flat portion, the flat portion being substantially parallel to the second surface, and the nozzle hole communicating with the liquid chamber in the flat portion.

According to another aspect of the invention, there is provided a method for producing a droplet dispensing head including: forming a nozzle plate by forming a liquid chamber, the liquid chamber opening in a first surface of a plate-like body; forming a flat portion in a bottom of the liquid chamber; and forming a nozzle hole, the nozzle hole communicating with the flat portion and opens in a second surface of the plate-like body; and providing a pressurizing device covering the liquid chamber of the plate-like body.

According to another aspect of the invention, there is provided a droplet dispensing device including: a droplet dispensing head; a moving equipment being configured to relatively move positions of an object to be treated and the droplet dispensing head; and a liquid-containing equipment being configured to contain a liquid, the droplet dispensing head including: a nozzle plate; and a pressurizing device configured to apply a pressure to a liquid in a liquid chamber, the nozzle plate having: a flow channel opening in a first surface of the nozzle plate; a liquid chamber communicating with the flow channel; and a nozzle hole communicating with the liquid chamber and opening in a second surface of the nozzle plate, the liquid chamber having a flat portion, the flat portion being substantially parallel to the second surface, and the nozzle hole communicating with the liquid chamber in the flat portion.

FIGS. from 8A to 8H are schematic section views showing the method for producing the droplet dispensing head.

Figure 9A:
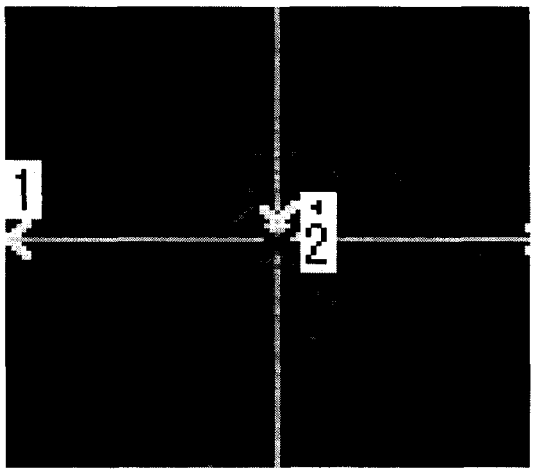
Figure 9B:
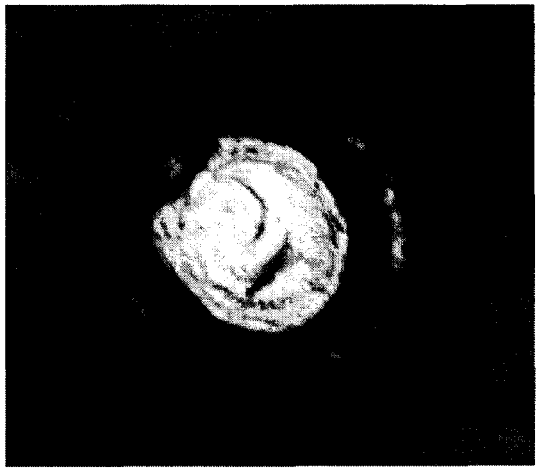
Figure 9C:
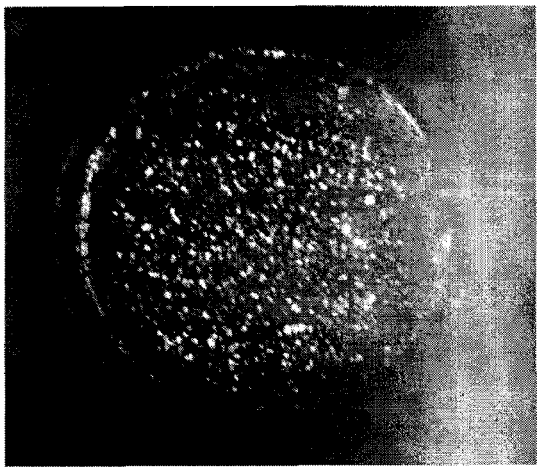

FIGS. 9A, 9B and 9C are photographic views for explaining the processed state of the flat portion.

Figure 10:
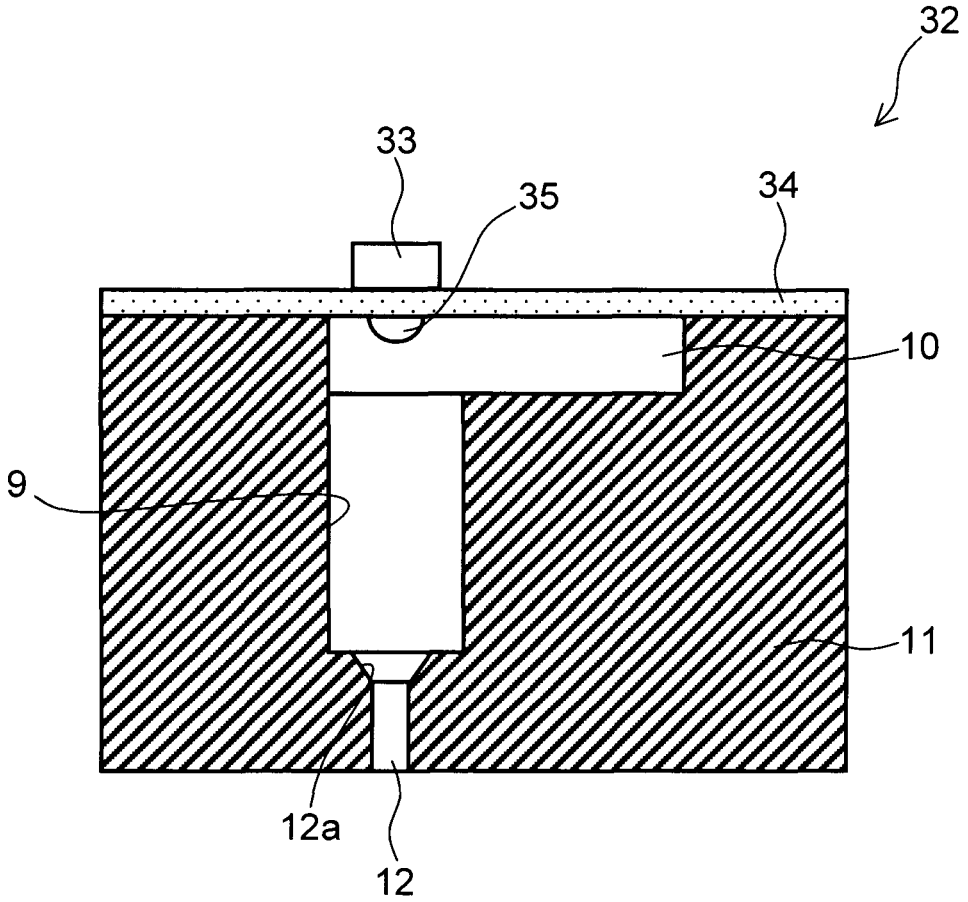

FIG. 10 is a schematic section view for exemplifying a structure of a thermal-type droplet dispensing head.

Figure 11:
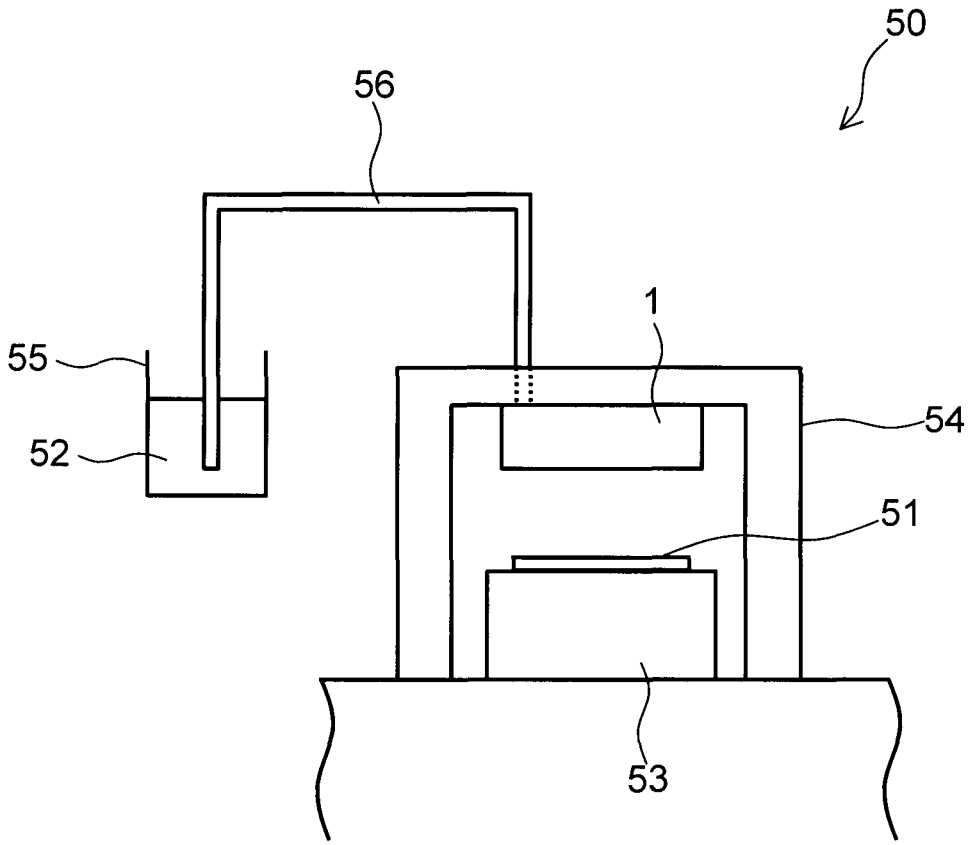

FIG. 11 is a schematic view for exemplifying the droplet dispensing device according to an embodiment of the invention.

Figure 12A:
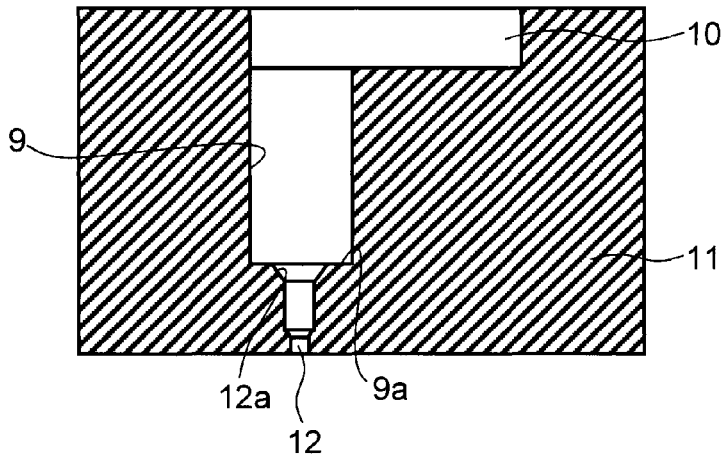
Figure 12B:
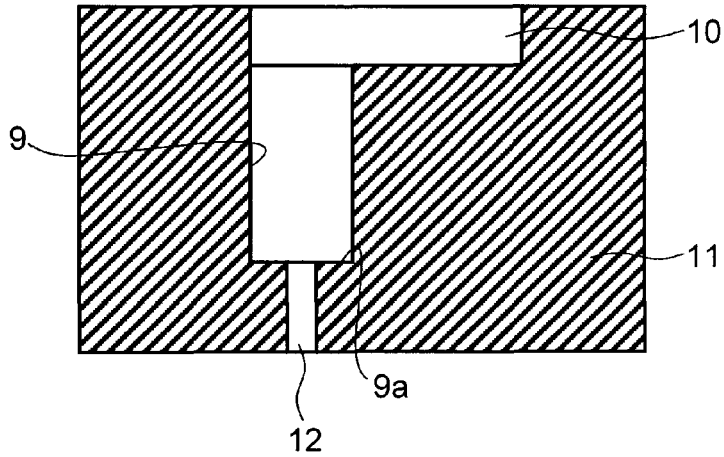
Figure 12C:
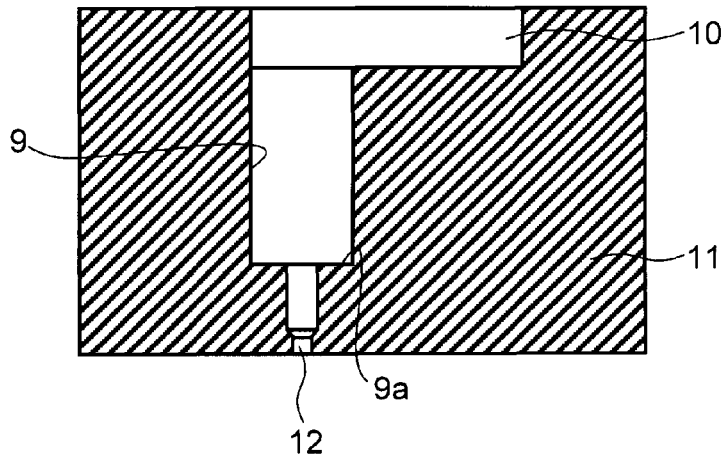

FIGS. 12A, 12B and 12C are schematic section views for examples of nozzle plate according to an embodiment of the invention.

DETAILED DESCRIPTION OF THE INVENTION

Hereinafter, embodiments of this invention will be explained with reference to drawings.

Figure 1:
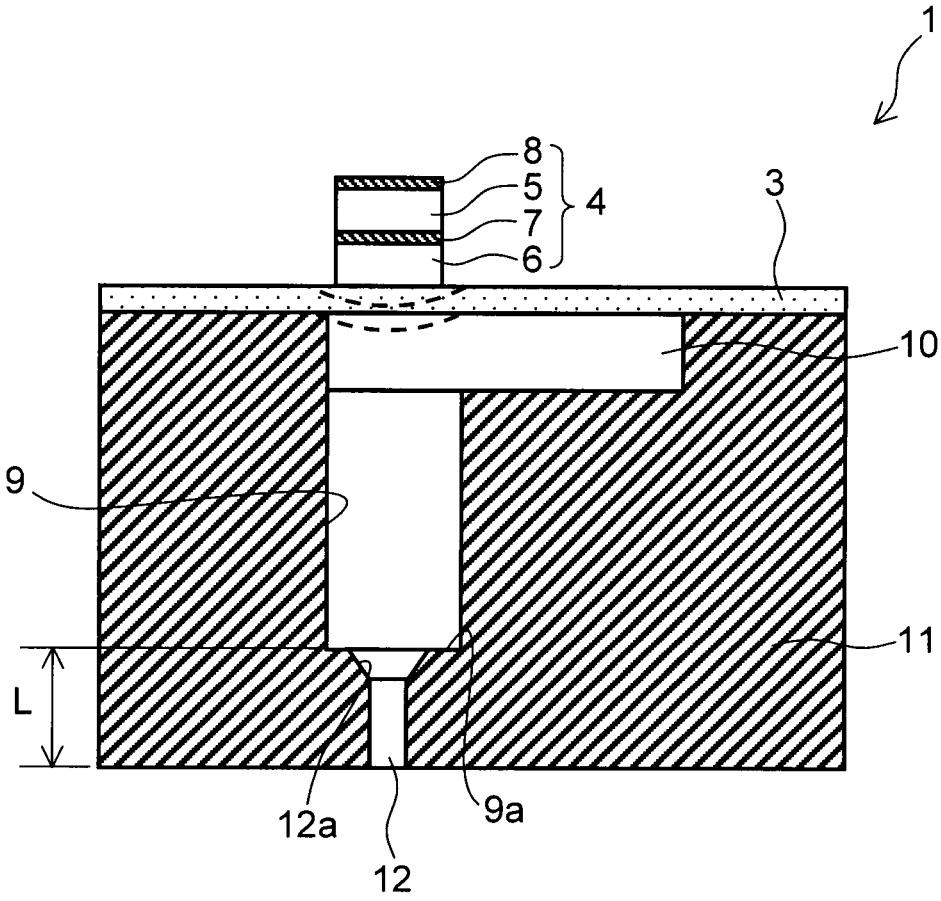
FIG. 1 is a schematic section view of a droplet dispensing head according to an embodiment of the invention.

FIG. 1 is a schematic section view of a droplet dispensing head 1 having a nozzle plate 11 according to an embodiment of this invention.

Figure 2:
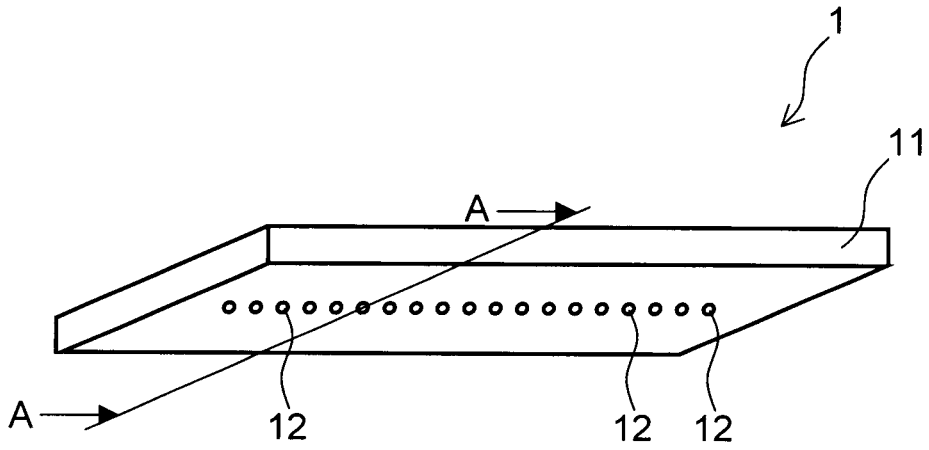
FIG. 2 is a schematic external view of the droplet dispensing head.

FIG. 2 is a schematic external view of the droplet dispensing head 1.

As exemplified in FIG. 2, the droplet dispensing head 1 is a droplet dispensing head of a so-called multi-nozzle type having a plurality of nozzle holes 12. Moreover, FIG. 1 is an enlarged view of the cross section of A-A direction in FIG. 2.

Here, methods of driving the droplet dispensing head 1 includes "Thermal type" of generating a bubble by heating to dispense a liquid by utilizing a film-boiling phenomenon and "Piezoelectric type" of dispensing a liquid by utilizing a bending displacement of a piezoelectric element. For convenience of explanation, here, the piezoelectric type is exemplified and explained.

As shown in FIG. 1, the droplet dispensing head 1 has a flexible film 3 provided on the nozzle plate 11 and a piezoelectric element 4 provided on the flexible film 3. In the case of "Piezoelectric type", the flexible film 3 and piezoelectric element 4 become a pressuring means for applying a liquid in a liquid chamber 9. The piezoelectric element 4 is produced by laminating a lower member 6, a driving electrode 7, an upper member 5, and a driving electrode 8 in the order and then integrally baking them. The piezoelectric element 4 baked integrally as described above has high strength and is easy to be handled.

A flow channel 10 is provided so as to be open in a front surface (upper surface i.e. the first surface) of the nozzle plate, and the flexible film 3 is provided so as to cover the opening of the flow channel 10.

The opposite surface to the side of the opening of the flow channel 10 is communicated with the liquid chamber 9. A plurality of the liquid chambers 9 is provided, and there are the respective flow channels communicated with the liquid chambers.

In one end (lower end) of the liquid chamber 9, a flat portion 9*a* is provided so as to be communicated with the liquid chamber 9. The flat portion 9*a* is set to be approximately parallel to a back surface (the second surface) of the nozzle plate 11. And, in the flat portion 9*a*, nozzle 12*a* is communicated. That is, a taper portion 12*a* provided at one end of the nozzle hole 12 is open, and the liquid chamber 9 and the nozzle hole 12 are communicated through the taper portion 12*a*. On the other end of the nozzle hole 12 is open in a back surface (lower surface i.e. the second surface) of the nozzle plate 11. The volume of the taper portion 12*a* is small, and therefore, can be regarded as a part of the nozzle hole 12. Therefore, the size from the flat portion 9*a* (the lower end of the liquid chamber 9*a*) to the opening of the nozzle hole 12 is a nozzle length L.

In the upper surface of the flexible film 3, the piezoelectric element 4 is provided. In this case, it is preferable that the piezoelectric element 4 is right above the liquid chamber 9 so that pressure waves due to bending displacement of the piezoelectric element 4 become easy to transmit to a liquid in the liquid chamber 9.

However, layout and shape thereof are not limited to the exemplified ones in FIG. 1, various modifications are possible. For example, the respective liquid chamber 9 may not be necessarily communicated with the flow channels 10 that are specially provided, and the plurality of liquid chambers 9 may be communicated with one common flow channel 10. In the structure of the piezoelectric element 4, the lower member 6 becomes a vibrating plate, and the upper plate becomes a piezoelectric body, but the members are not limited thereto, and also, various driving methods for generating the displacement can be adopted.

The material of the nozzle plate 11 can be stainless steel, nickel alloy, or the like, and the material of the flexible film 3 can be polyethyleneterephthalate, and so forth. Moreover, the materials of the lower and upper members 6, 5 of the piezoelectric element 4 can be piezoelectric ceramics (for example, lead zirconium titanate), and the driving electrodes 7, 8 can be a copper alloy, and so forth. However, these materials are not limited to the exemplified ones, and various modifications are possible. For example, the material of the nozzle plate 11 can be selected from the group consisting of a resin, a metal, a semiconductor material, and so forth, having corrosion resistance to a liquid to be dispensed.

Sizes of main parts of the droplet dispensing head 1 can be exemplified as follows. A thickness of the nozzle plate 11 can be approximately from 1 mm to some millimeters, and a sectional shape of the flow channel 10 can be approximately some millimeters in height (thinner than the height of the liquid chamber 9)×approximately some 100 μm in width, and a diameter of the nozzle hole 12 that is an opening with cylindrical shape can be approximately from 20 μm to 50 μm, and a diameter of the liquid chamber 9 can be approximately from 250 μm to 600 μm, and a thickness of the flexible film 3 can be 10 μm, a thickness of the piezoelectric element 4 can be approximately 30 μm.

It is preferable that the nozzle length L is from 50 μm to 150 μm. If less than 50 μm, the strength in the vicinity of the opening portion of the nozzle hole becomes low, and an increase of internal pressure in droplet dispensing may cause a deformation in the vicinity of the opening. Moreover, more than 150 μm is not preferable from the view point of workability of the nozzle hole or increase of dispense resistance.

It is preferable that a diameter of the liquid chamber 9 is from 5 to 30 when a diameter of the nozzle hole is set to 1. Moreover, it is more preferable that the diameter is from 8 to 20. This is because if more than 30, the area to be pressurized becomes too large and by an increase of the internal pressure in the droplet dispense, a large force is applied in the vicinity of the opening portion, and therefore, there is danger of generating a deformation in the vicinity of the opening portion. Moreover, if less than 5, it becomes difficult to improve the processing accuracy in the depth direction of the liquid chamber 9 (position accuracy of the flat portion 9*a*), and also it is not easy to ensure concentricity of the liquid chamber 9 and the nozzle hole 12 and a problem is caused in operation characteristics such as a registration characteristic or a flight characteristic.

It is preferable that a flatness of the flat portion 9*a* is 10 μm or less. This is because if more than 10 μm, error of processing is caused in processing the nozzle hole 12, and therefore, a problem is caused in operation characteristics such as a registration characteristic or a flight characteristic.

Moreover, a shape of the section of the flow channel 10 is a rectangle in the figure, but is not limited thereto and may have roundness in the corners thereof. The size and shape are not limited to the exemplified ones, but various modifications are possible.

Here, as a result of a study, the present inventor has obtained knowledge that when the size from one end (lower end) of the liquid chamber 9 which is a portion supplying a liquid to be dispensed to the opening portion of the nozzle hole 12 namely the nozzle length L varies, the variation exerts a bad influence on the fundamental characteristics such as a registration characteristic or a flight characteristic.

Figure 3:
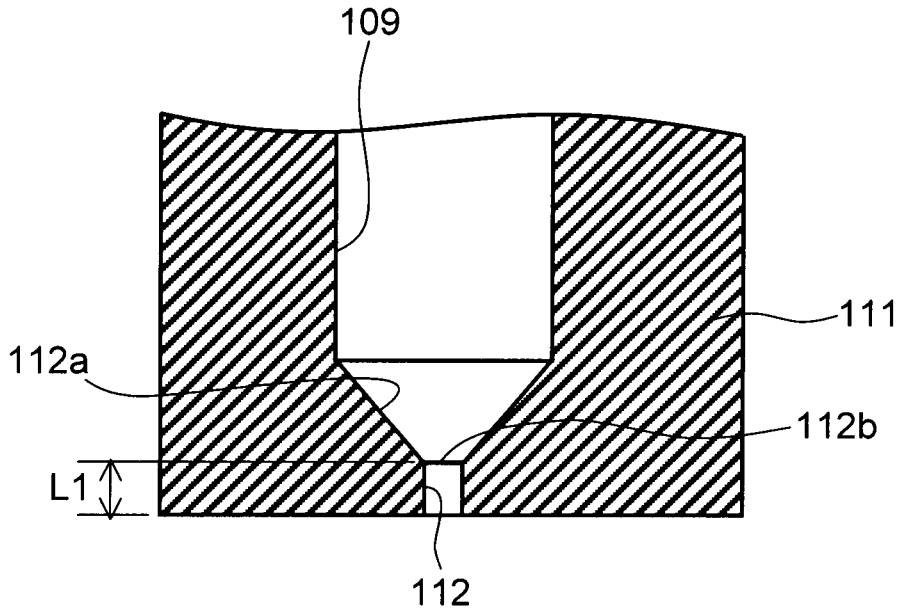
FIG. 3 is a schematic view for explaining the vicinity of one end (lower end) of a conventional liquid chamber.

FIG. 3 is a schematic view for explaining the vicinity of one end (lower end) of a conventional liquid chamber.

As shown in FIG. 3, in one end (lower end) of a liquid chamber 109 provided in a nozzle plate 111, a taper portion 112*a* is provided and the liquid chamber 109 and the nozzle hole 112 are communicated through the taper portion 112*a*. The upper opening size of the taper portion 112*a* is the approximately same as the sectional size of the liquid chamber 109. And, the other end of the nozzle hole 112 is open in the back surface (lower surface) of the nozzle plate 111.

In the case of the nozzle plate 111, the flat portion 9*a* is not provided in one end (lower end) of the liquid chamber 109. Moreover, the sectional size of the taper portion 112*a* is large and the taper potion 112*a* has a function of supplying a liquid in the same manner as the liquid chamber 109. Therefore, the taper portion 112*a* can be regarded as a part of the liquid chamber 109.

In this case, the size from a junction 112*b* which is a part of connecting the taper portion 112*a* and the nozzle hole 112 to the opening of the nozzle hole 112 becomes the nozzle length L1, and the position accuracy of the junction 112*b* becomes an important factor for accuracy of the nozzle length.

The position of this junction 112*b* is determined in processing the nozzle hole 112, but the position accuracy thereof has not been considered conventionally.

Figure 4A:
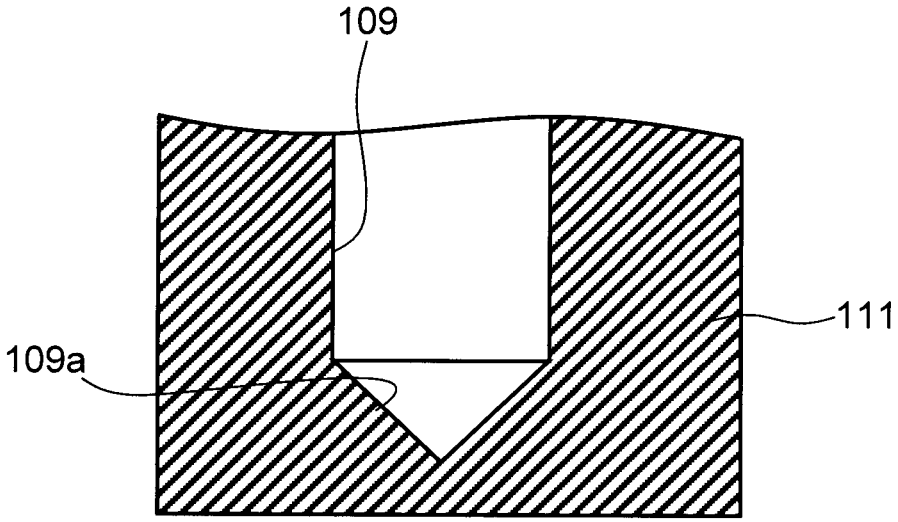
FIGS. 4A and 4B are schematic views for explaining processing of the nozzle hole.
Figure 4B:
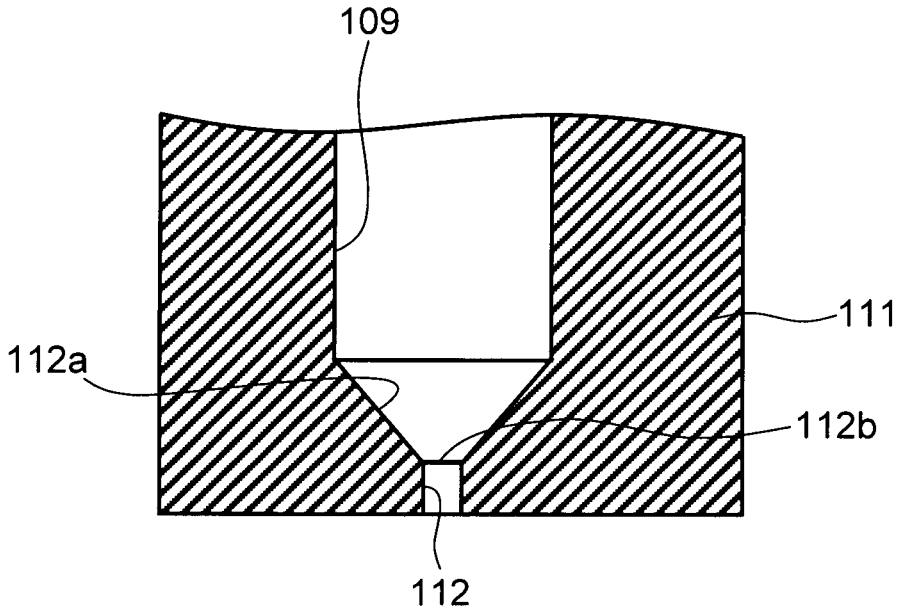

FIGS. 4A and 4B are schematic views for explaining processing of the nozzle hole.

In processing the liquid chamber 109, a drill whose tip end is a cone shape is generally used. First, as shown in FIG. 4A, a hole is opened in the nozzle plate 111 by the drill. After processing, a hole having a tip end 109*a* of a cone shape is opened, and the straight portion becomes the liquid chamber 109.

Next, as shown in FIG. 4B, the nozzle hole 112 is processed so that the cone-shaped tip end 109*a* serves as the guidance. In the cone-shaped tip end 109*a*, the residual portion after processing of the nozzle hole 112 becomes the taper portion 112*a*. Moreover, the portion of connecting the taper portion 112*a* and the nozzle hole 112 becomes the junction 112*b*.

Here, the size of the cone-shaped tip end 109*a* varies drastically due to sharpening condition of the drill tip end or due to an abrasion of the drill tip end. As a result, the position of the junction 112*b* varies and therefore it is difficult to improve the accuracy of the nozzle length L1. In particular, in such a plate having many nozzle holes as a multi-nozzle type as shown in FIG. 2, it is extremely difficult to uniform all the nozzle lengths L1 in one nozzle plate.

Moreover, the surface of the tip end 109*a* is rough as described later, and therefore, if the nozzle hole 112 is processed using the tip end as the guidance, the nozzle hole 112 is opened so as to bend, and there is a problem that the accuracy of pitch size between the nozzle holes 112 deteriorates.

On the other hand, in the nozzle plate 11 according to this embodiment, the flat portion 9*a* is provided in one end (lower end) of the liquid chamber 9 as described above. Moreover, the taper portion 12*a* is small and can be regarded as a part of the nozzle hole 12. Therefore, the size from the flat portion 9*a* (lower end of the liquid chamber 9) to the opening portion of the nozzle hole 12 becomes nozzle length L. In this case, the flat portion 9*a* can make the position accuracy or the flatness, and therefore, the size accuracy of the nozzle length L can be improved drastically. As a result, the operation characteristics such as a registration characteristic or a flight characteristic can be drastically improved.

Moreover, because the flat portion 9*a* can be a flat surface to be described later, the nozzle hole 12 having excellent straightness can be processed, and the accuracy of the pitch size of the nozzle holes 12 can also be drastically improved.

Figure 5A:
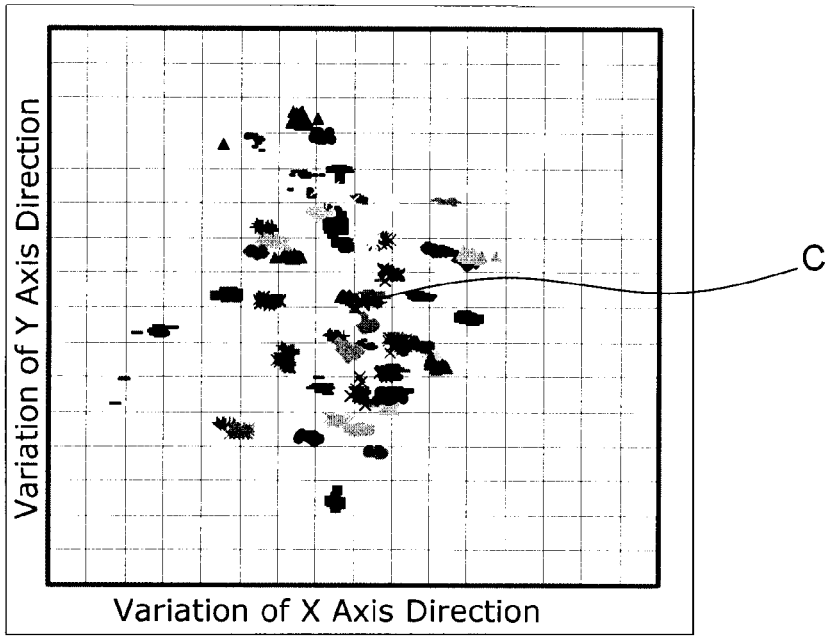
FIGS. 5A and 5B are graphs for explaining registration characteristics.
Figure 5B:
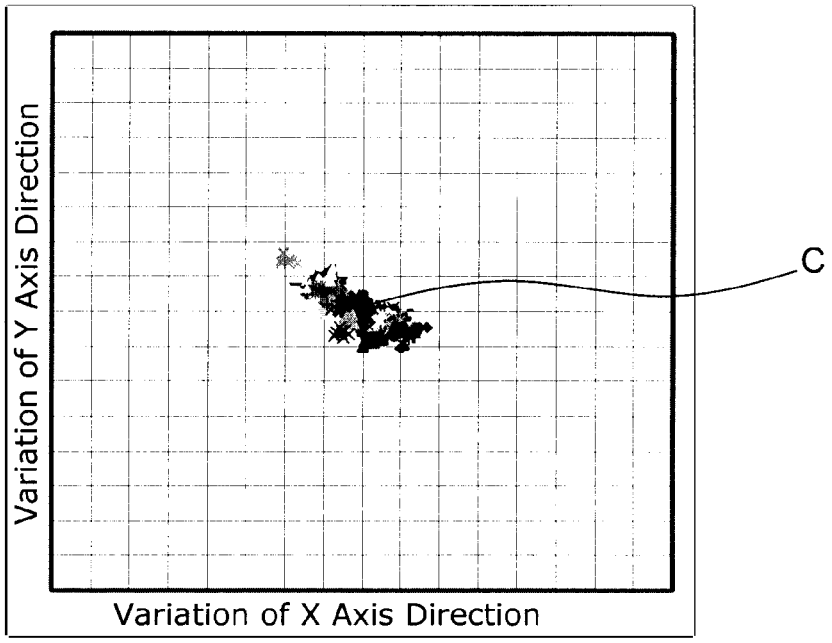

FIGS. 5A and 5B are graphs for explaining registration characteristics.

FIG. 5A shows a registration characteristic of the nozzle plate 111 having the nozzle hole 112 explained in FIGS. 3, 4A and 4B, and FIG. 5B shows a registration characteristic of the nozzle plate 11 having the nozzle hole 12 according to this embodiment. In each of the registration characteristics of these cases, registration errors with respect to 64 nozzle holes are plotted on one graph. The conditions except for the nozzle plates are the same. Also, the registration targets in both of FIGS. 5A and 5B are set to C points that are the centers of the graph views.

As shown in FIG. 5A, it can be seen that in the nozzle plate 111 having a conventional nozzle hole 112, the registration positions vary with two-dimensional spread. On the other hand, as shown in FIG. 5B, it can be seen that in the nozzle plate having the nozzle hole 12 according to this embodiment, the registration can be concentrated in the vicinity of the C point, which is the registration target.

Figure 6A:
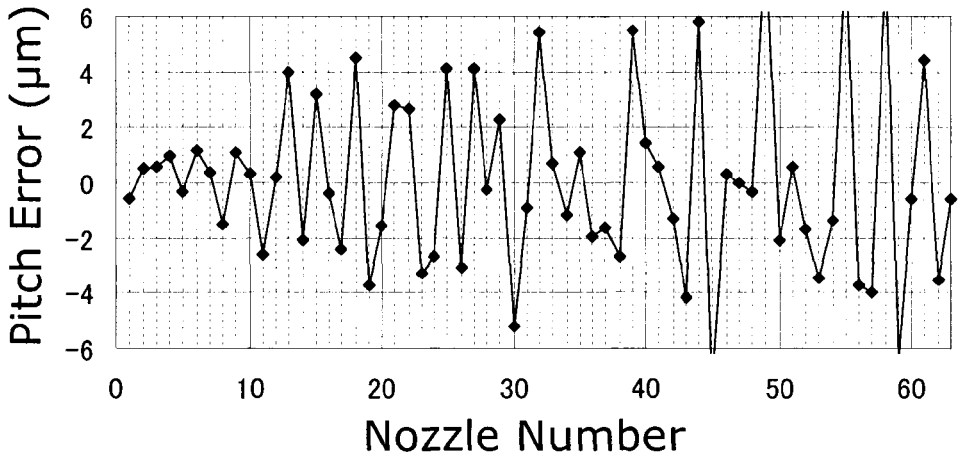
FIGS. 6A and 6B are graphs for explaining pitch size accuracy of nozzle holes.
Figure 6B:
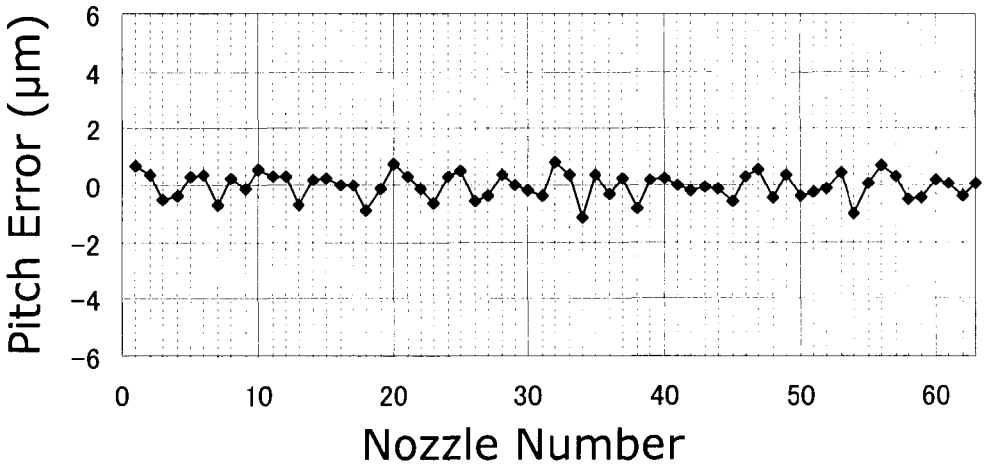

FIGS. 6A and 6B are graphs for explaining pitch size accuracy of the nozzle holes.

FIG. 6A shows pitch size accuracy of the nozzle holes 112 explained in FIGS. 3, 4A and 4B. FIG. 6B shows pitch size accuracy of the nozzle holes 12 according to this embodiment. The measured objects in these cases are the nozzle plates of multi-nozzle type as shown in FIG. 2. The numbers of the horizontal axis of the graph show the individual nozzle holes in the multi nozzle, and the vertical axis shows pitch errors.

As is clear from FIGS. 6A and 6B, accuracy of the pitch sizes of the nozzle holes 12 can be drastically improved by the nozzle holes 12 according to this embodiment.

Next, action of the droplet dispensing head 1 will be explained.

When voltage is applied to the driving electrodes 7 and 8, the upper material 5 generates convex bending displacement below, and therewith, the piezoelectric element 4 with a laminated structure generates convex bending displacement below. As shown by dashed lines in FIG. 1, this bending displacement pushes down the flexible film 3 below and pressurizes the liquid in the liquid chamber 9 to the direction of the nozzle hole 12. Therefore, the liquid depending on the bending displacement becomes dispensed by the nozzle hole 12.

The decreased liquid by dispensing is replenished from a liquid-containing means, which is not shown, through the flow channel 10. The bending displacement of the piezoelectric element 4 can be controlled if the applied voltage is controlled, and therefore, the dispensing amount can be controlled by a control device, which is not shown. The bending displacement of the piezoelectric element 4 is absorbed in the flexible film 3 and reciprocal interference between the contiguous piezoelectric elements or the contiguous pressure chambers can be prevented.

Next, a method for producing the droplet dispensing head 1 will be explained.

Figure 7:
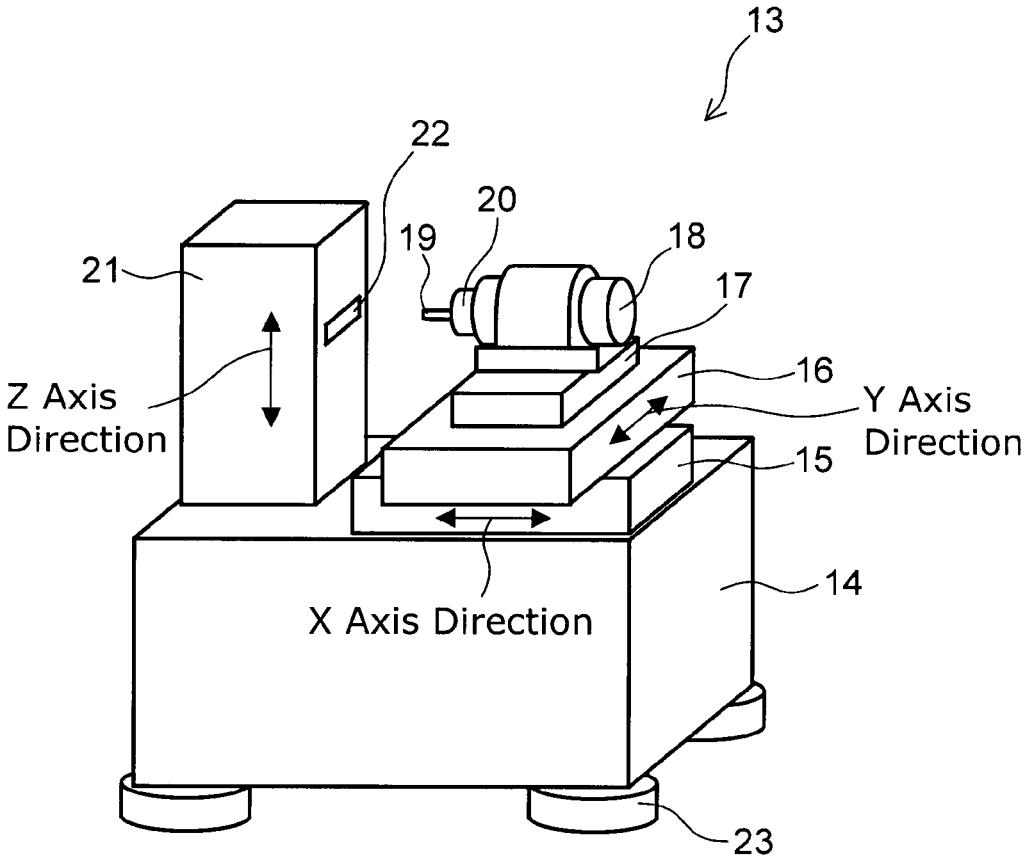
FIG. 7 is a schematic view for exemplifying a processing means used for processing of the nozzle plate.

FIG. 7 is a schematic view for exemplifying a processing means 13 used for processing of the nozzle plate 11.

An X axis table 15 is provided on the upper surface of the frame 14. On the X axis table 15, a Y axis table 16 is provided. Moreover, on the Y axis table 16, a rotational spindle 18 is provided through a spacer 17, and in the rotational spindle 18, a machine-tool holding means 20 is provided.

Moreover, a tool 19 held in the machine-tool holding means 20 can be exchanged by a machine-tool exchange means, which is not shown. A Z axis table 21 is provided on the upper surface of the frame 14, and on the Z axis table 21, a holding means 22 for holding an object to be processed is provided. On the surface of the frame 14, feet 23 are provided.

The X axis table 15 has a function of moving the Y axis table 16 to X axis direction in the figure, and the Y axis table 16 has a function of moving the spacer 17 and the rotational spindle 18 to the Y axis direction in the figure. The rotational spindle 18 has a function of rotating the machine tool 19 held by the machine-tool holding means 20. The spacer 17 may have a function of preventing external vibration from transmitting to the rotational spindle 18.

The Z axis table 21 has a function of moving the object to be processed held in the holding means 22 to the Z axis direction in the figure. The foot 23 prevents vibration from the outside from transmitting to the frame 14 and has a function of adjusting the upper surface of the Z axis table 21 to be horizontal. Position control of the X axis table 15, the Y axis table 16, the Z axis table or rotational control of the rotational spindle 18, and so forth are performed by control means, which are not shown.

The processing means 13 shown in FIG. 7 is only an example and is not limited thereto. Moreover, as the processing methods, cutting processing, various physical or chemical removal methods such as dry etching processing, wet etching processing, electrical discharge machining, laser machining, and plasticity processing, can be adopted. Also, these methods can be appropriately combined as needed.

FIGS. from 8A to 8H are section views showing the method for producing the droplet dispensing head 1.

The same reference numerals are appended for the same parts as FIG. 1.

Figure 8A:
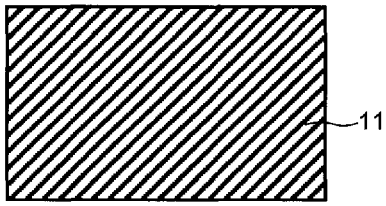

First, the periphery of a plate member is processed as shown in FIG. 8A to produce a nozzle plate 11 of a plate-like body in a blank state.

Figure 8B:
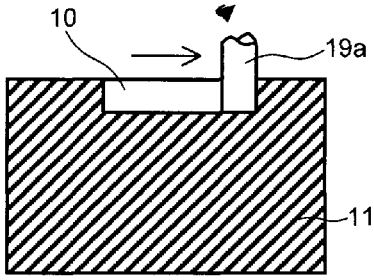

Next, as shown in FIG. 8B, the nozzle plate 11 in a blank state is held in the holding means 22 of the above-described processing means 13, a machine tool 19*a* held in the machine-tool holding means 20 is rotated by the rotational spindle 18, and thereby, the flow channel 10 is processed. As the machine tool 19*a* used in this case, a machine tool that is suitable for cutting a groove can be used. Moreover, the processing positions are determined by movements of the X axis table, the Y axis table, and the Z axis table by control means, which are not shown, and also, the processing condition such as machine-tool rotation speed is appropriately determined.

Figure 8C:
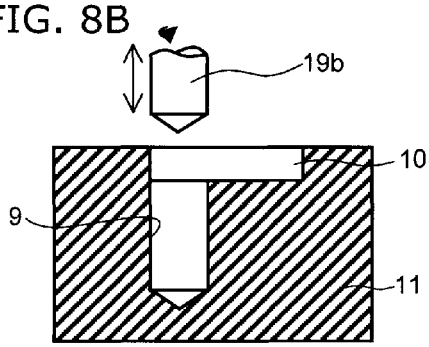

Next, a machine tool 19*b* held in the machine-tool holding means 20 as shown in FIG. 8C is rotated by the rotational spindle 18 to process the liquid chamber 9. The machine tool 19*b* exemplified in FIG. 8C is a drill, but is not limited thereto, and a suitable tool for opening a hole can be appropriately used. Moreover, the processing position, the processing condition, and so forth are appropriately determined in the same manner as the above-described case. The machine tool 19*b* is exchanged by a machine-tool exchange means, which is not shown. In this stage, a cone-shaped concave portion remains in the bottom side of the liquid chamber 9.

Figure 8D:
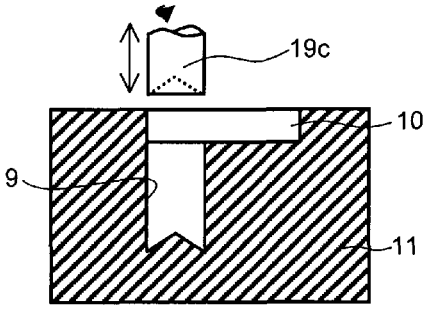

FIG. 8D is the case that an end mill is used as a machine tool 19*c* for processing the liquid chamber 9. Explanation of the processing method and such is omitted because of being the same as the case of FIG. 8C. In this case, a cone-shaped convex portion remains in the bottom side of the liquid chamber 9.

Figure 8E:
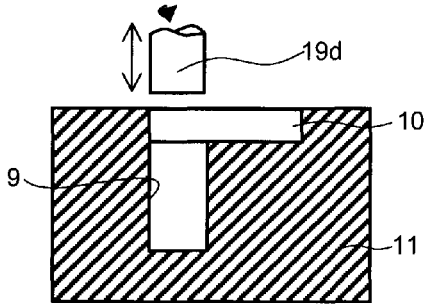

Next, as shown in FIG. 8E, the cone-shaped concave and convex portions remaining in the bottom side of the liquid chamber 9 is removed to form a flat portion 9*a*. A machine tool 19*d* exemplified in FIG. 8E is a tool whose end is flat and end portion also has a cutting edge, but is not limited thereto, and may be a tool being capable processing the bottom to be flat. Also, the processing method can be appropriately selected, and includes die-sinking electrical discharge machining by a shaped electrode or fine-pore electrical discharge machining by a pipe electrode. The processing position, the processing condition, and so forth are appropriately determined in the same manner as described above, and also, the tool 19*d* can be exchanged by a machine-tool exchange means, which is not shown.

Figure 8F:
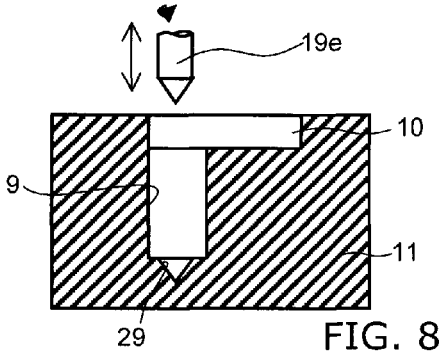

Next, as shown in FIG. 8F, a machine tool 19*e* held in the machine tool holding means 20 is rotated by the rotational spindle to perform prepared hole processing (center-hole processing) of the nozzle hole 12. The prepared hole processing (center-hole processing) is for improving processing accuracy of the following processing of the nozzle hole 12.

Specifically, by the machine tool 19*e* having a somewhat larger diameter than that of the nozzle hole 12 and having an approximately-V-shaped cutting-edge shape, an approximately V-shaped concave 29 is processed. Also, it is possible that rotation of the rotational spindle 18 is stopped and the machine tool 19*e* is impact pressed to form the concave 29 by plastic deformation. The machine tool 19*e* is exchanged by the machine-tool exchange means, which is not shown.

Figure 8G:
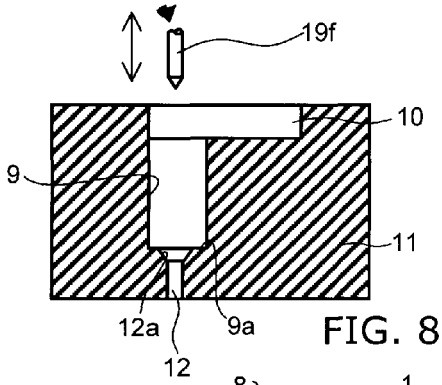

Next, as shown in FIG. 8G, the machine tool 19*f* held in the machine-tool holding means 20 is rotated by the rotational spindle 18 to drill a hole to form the nozzle hole 12. In this case, the machine tool 19*f* is guided by a centering action of the approximately V-shaped concave 29, and vibration of the machine tool 19*f* is suppressed, and also, so-called biting effect becomes good, and therefore, cutting property in the start of processing becomes favorable. After hole processing of the nozzle hole 12, burr removal in the processed portion, removal of processing scraps, and so forth are performed.

By processing of such a procedure as described above, the nozzle plate 11 having the excellent nozzle holes 12 that are high in roundness, concentricity, straightness, size accuracy, position accuracy, and so forth can be obtained.

Moreover, because the flat portion 9*a* can be formed, the higher processing accuracy of the nozzle holes can be obtained, and the operation characteristics such as a registration characteristic and a flight characteristic or pitch characteristics as described above can be drastically improved.

Such a nozzle plate 11 having a nozzle hole 12 with high accuracy cannot be obtained in the case that the member in the vicinity of the nozzle hole and the nozzle plate main body are individually produced and firmly fixed with adhesive and such or in the case that a large hole is opened and subjected to electroplating to reduce the nozzle hole opening size.

Figure 8H:
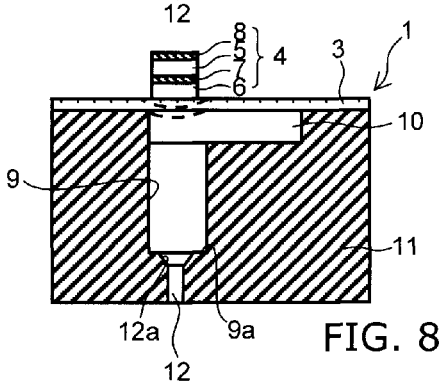

Next, as shown in FIG. 8H, the flexible film 3 is liquid sealing bonded to the upper surface of the flow channel 10 of the nozzle plate 11 with an epoxy-based adhesive, and the piezoelectric element 4 is placed on the upper surface of the flexible film 3. In this case, the piezoelectric element 4 is placed right above the liquid chamber 9. The piezoelectric element 4 is previously produced by baking integrally after laminating a lower member 6, a driving electrode 7, an upper member 5, and a driving electrode 8 in the order. As described above, the droplet dispensing head 1 according to this embodiment is accomplished.

FIGS. 9A, 9B and 9C are photographic views for explaining the processed state of the flat portion.

FIG. 9A is a photographic view when the cone-shaped concave portion remaining in the bottom side of the liquid chamber 9 explained in FIG. 8C is viewed from above (from the liquid chamber 9 side). As seen from FIG. 9A, the pattern with a concentric circular shape can be seen, and badness of the size accuracy and drastic roughness on the surface of the face can be seen. This is the same with respect to the cone-shaped convex portion explained in FIG. 8D.

FIG. 9B is a photographic view when the flat portion 9*a* subjected to the cutting processing explained in FIG. 8E is seen from above (from the liquid chamber 9 side). As seen from FIG. 9B, there is no pattern with a concentric circular shape, it can be seen that the size accuracy and the flatness are favorable.

FIG. 9C is a photographic view when the flat portion 9*a* after the process of die-sinking electrical discharge machining by a shaped electrode explained in FIG. 8E is seen from above (from the liquid chamber 9 side). As seen from FIG. 9C, there is no pattern with a concentric circular shape, it can be seen that the size accuracy and the flatness are favorable.

Next, the droplet dispensing head according to another embodiment will be explained.

FIG. 10 is a schematic section view for exemplifying a structure of a thermal-type droplet dispensing head for dispensing a liquid by heating.

The same reference numerals are appended in the same components as described above on FIG. 1, and only different parts will be mainly explained.

In the droplet dispensing head 32, a protective film 34 is placed on the nozzle plate 11, and furthermore, a heater element 33 is placed on the protective film 34. In the case of "thermal type", the protective film 34 and the heater element 33 become pressurizing means for applying pressure to a liquid in the liquid chamber 9. The heater element 33 is formed by a resistant thin film composed of an electric resistance material, and generates Joule heat when an electric power is supplied from a power supply means, which is not shown. The protective film 34 is formed by an inorganic material such as silicon oxide or silicon nitride. A thickness of the protective film 34 can be approximately 2 μm and a thickness of the heater element 33 can be approximately 3 μm. However, arrangement, shape, size, and material thereof are not limited to the exemplified ones in FIG. 8, and various modifications are possible.

Next, the action of the droplet dispensing head 32 will be explained. The heater element 33 is made to generate heat by supplying electric power to the heater element 33 from the power supply means, which is not shown. By heat-generating of the heater element 33, a bubble 35 is generated in the liquid. By the pressure of the generated bubble 35, the liquid in the liquid chamber 9 is pressurized to the direction of the nozzle hole 12. The liquid corresponding to the pressure is dispensed. The decreased liquid by dispensing is replenished from a liquid supply means, which is not shown, through the flow channel 10. The generated bubble 35 disappears so as to constrict with being deprived of heat by the surrounding liquid, and the following heat generation and bubble generation are waited. When the supply power is controlled in a set of the processes, size of the bubble 35 or timing of generation thereof can be controlled, and therefore, when the supply power is controlled by a control device which is not shown, the dispensing amount or the dispensing timing can be controlled.

Explanation of a method for producing the droplet dispensing head 32 is omitted because the method is the same as described above with respect to FIGS. F*rom* 8A and 8B except that the piezoelectric element 4 is replaced by the heater element 33.

As explained above, the droplet dispensing head according to this invention has a nozzle plate provided with an above-described nozzle hole, and therefore, has good operation characteristics such as a registration characteristic and a flight characteristic and also pitch characteristics can be drastically improved.

Next, a droplet dispensing device 50 will be explained.

FIG. 11 is a schematic view for exemplifying the droplet dispensing device 50 according to an embodiment of the invention.

As shown in FIG. 11, the droplet dispensing device 50 has the droplet dispensing head 1 for dispensing a liquid 52 toward an object to be treated 51, a moving means 53 being capable of moving the object to be treated such as a substrate with putting or holding the object thereon, a holding means 54 for holding the droplet dispensing head 1, and a liquid-containing means 55 such as a tank for containing the liquid 52. The droplet dispensing head 1 and the liquid containing means 55 are connected with a tube 56 and the liquid 52 can be supplied to the droplet dispensing head 1. The droplet dispensing head 1 may be a droplet dispensing head according to this invention, and for example, can be the droplet dispensing head 32. Moreover, FIG. 11 shows a schematic structure, and in addition to them, for example, a control means for controlling operation of the droplet dispensing device, a means for exhausting the surplus liquid 52, or the like can be provided.

Such a droplet dispensing device 50 can be used for formation of an orientation film of a liquid crystal display device, formation of a colored portion of a color filter, formation of a photoresist film on a semiconductor device substrate. Therefore, as the liquid 52, various liquids such as an orientation film material, a dye such as red (R)•green (G)•blue (B), a photoresist liquid, a liquid crystal mixed with a spacer for controlling a gap, can be used.

Next, the action of the droplet dispensing device 50 will be explained.

First, the object to be treated 51 is put and held on the moving means 53. Next, the liquid 52 is dispensed toward the object to be treated 51 from the droplet dispensing head 1. Next, by the moving means 53, the object to be treated 51 is moved and thereby a portion to be next treated becomes under the droplet dispensing head 1. Hereinafter, the above-described procedure is repeated to perform treatment such as film-forming on the object to be treated 51. In this case, through the tube 56, the liquid 52 is supplied to the droplet dispensing head 1 from the liquid-containing means 55.

Here, the movement direction of the moving means 53 may be an uniaxial direction (for example, thickness direction of the page space), a biaxial direction (horizontal direction), a triaxial direction, or a rotational direction, and as long as the relative position of the droplet dispensing head 1 and the object to be treated 51 can be changed, either of them may be moved. Specifically, an X-Y table, a conveyer, a spin table, and an industrial robot can be exemplified. Moreover, in the supply of a liquid from the liquid-containing means 55 to the droplet dispensing head 1, a water position head or the like may be utilized without using a specific device, or a liquid transport means such as a pump may be used.

The droplet dispensing device according to this embodiment is explained by the device that can be used for thin-film formation, but is not limited thereto, and is applicable to a so-called inkjet recording device for printing a character or a design on a page space. In this case, as the structure of an inkjet recording device except for the droplet dispensing head according to this embodiment, an known structure can be used, and therefore, explanation thereof is omitted.

Because the droplet dispensing head provided with the above-described nozzle hole is used, the droplet dispensing device according to this embodiment has excellent operation characteristics such as a registration characteristic and a flight characteristic and can perform a high accuracy dispensing in which the pitch accuracy is drastically improved. This becomes particularly advantageous, for example, in such a case that a fine registration characteristic is required as formation of a colored portion of a color filter.

As described above, embodiments of this invention has been explained with reference to specific examples. However, this invention is not limited to the specific examples.

The specific examples subjected to appropriate design change by those skilled in the art is also included in the scope of this invention as long as having the characteristics of this invention.

For example, this invention is applicable to a droplet dispensing head having a single nozzle hole or the like as well as a droplet dispense nozzle of multi-nozzle type. As the flexible film 3, every material such as a metal film may be used without being limited to the exemplified resin film, as long as being capable of shielding the liquid to be dispensed from infiltrating into the piezoelectric element 4 and having flexibility. The piezoelectric element 4 may have three or more layers without being limited to the two-layer structure, and the material thereof is not limited to the exemplified one. Also, the piezoelectric element is not necessarily the integrally baked multilayered piezoelectric element. When the piezoelectric element 4 is placed on the flexible film 3, the fixing method can be performed by a bonding method including an epoxy-based adhesive. The protective film 34 is not limited to the exemplified inorganic material as long as being capable of shielding the liquid to be dispensed from infiltrating into the heater element 34 and having heat resistance. As the method for bonding the heater element 34 and the protective film 35 or the protective film 35 and the nozzle plate 11, another bonding method can be used without being limited to the epoxy-based adhesive and such.

Moreover, shape, size, material, layout, and so forth of each of the components of the nozzle plate, the droplet dispensing head, the droplet dispensing device, and so forth as exemplified as the specific examples are not limited to the exemplified ones, and can be appropriately modified.

FIGS. 12A, 12B and 12C are schematic section views of examples of nozzle plate according to an embodiment of this invention. For example, with respect to shape of the nozzle hole portion, a multi-stage shape in the vicinity of the nozzle hole opening as shown in FIGS. 12A, a shape in which processing of the taper portion 12*a* is omitted and the nozzle hole 12 is directly communicated with the liquid chamber 9 as shown in FIG. 12B, and a multi-stage shape in the vicinity of the nozzle hole opening with omitting processing of the taper portion 12*a* as shown in FIG. 12C, are possible.

Moreover, the respective components that the specific examples have can be combined if at all possible, and the combined ones are included in the scope of this invention as long as containing the characteristics of this invention.

Moreover, the respective processing methods explained as the method for producing a nozzle plate and a method for producing a droplet dispensing head are not limited to the exemplified ones and can be appropriately modified.

The invention claimed is:

1. A method for manufacturing a nozzle plate, comprising:

forming a liquid chamber which opens in a first surface of a plate body, the liquid chamber having a convex portion in a lower end thereof;

forming a flat portion in the lower end of the liquid chamber by removing the convex portion; and forming a nozzle hole, the nozzle hole communicating with the flat portion and opening in a second surface of the plate body, wherein the liquid chamber, the flat portion and the nozzle hole are formed in the same plate body, wherein the forming the nozzle hole includes forming a substantially V-shaped concave portion in a section shape after forming the flat portion, and drilling a hole by a centering action of the concave portion.

2. The method for manufacturing a nozzle plate according to claim 1, wherein the forming the substantially V-shaped concave portion is a center-hole processing.

3. A method for manufacturing a droplet dispensing head, comprising:

forming a nozzle plate by:

forming a liquid chamber which opens in a first surface of a plate body, the liquid chamber having a convex portion in a lower end thereof;

forming a flat portion in the lower end of the liquid chamber by removing the convex portion; and forming a nozzle hole, wherein the forming the nozzle hole includes forming a substantially V-shaped concave portion in a section shape after forming the flat portion, and drilling a hole by a centering action of the concave portion, the nozzle hole communicating with the flat portion and opening in a second surface of the plate body, wherein the liquid chamber, the flat portion and the nozzle hole are formed in the same plate body; and providing a pressurizing device covering the liquid chamber of the plate body.

4. The method for manufacturing a droplet dispensing head according to claim 3, wherein the pressurizing device includes a piezoelectric element, the piezoelectric element being provided immediately above the liquid chamber.

5. The method for manufacturing a droplet dispensing head according to claim 3, wherein the pressurizing device includes a heater element, the heater element being provided immediately above the liquid chamber.

6. The method for manufacturing a nozzle plate according to claim 1, wherein the forming the liquid chamber includes:

forming the concave portion in the bottom of the liquid chamber by using a drill before forming the convex portion.

7. The method for manufacturing a nozzle plate according to claim 1, wherein the convex portion is formed by using an end mill.

8. The method for manufacturing a droplet dispensing head according to claim 3, wherein the forming the liquid chamber includes:

forming the concave portion in the bottom of the liquid chamber by using a drill before forming the convex portion.

9. The method for manufacturing a droplet dispensing head to claim 3, wherein the convex portion is formed by using an end mill.

10. The method for manufacturing a nozzle plate according to claim 1, wherein the nozzle plate is made of a metal.

11. The method for manufacturing a droplet dispensing head according to claim 3, wherein the nozzle plate is made of a metal.

12. The method for manufacturing a nozzle plate according to claim 1, wherein the nozzle hole is directly underneath the liquid chamber.

13. The method for manufacturing a droplet dispensing head according to claim 3, wherein the nozzle hole is directly underneath the liquid chamber.

* * * * *